US012734430B2

(12) United States Patent
Johnson

(10) Patent No.: US 12,734,430 B2
(45) Date of Patent: Sep. 15, 2026

(54) SYSTEMS AND METHODS FOR CONVERTING HOCKEY STICKS TO SKI POLES

(71) Applicant: Alex David Johnson, Chicago, IL (US)

(72) Inventor: Alex David Johnson, Chicago, IL (US)

( * ) Notice: Subject to any disclaimer, the term of this patent is extended or adjusted under 35 U.S.C. 154(b) by 158 days.

(21) Appl. No.: 18/972,023

(22) Filed: Dec. 6, 2024

(65) Prior Publication Data

US 2025/0186868 A1 Jun. 12, 2025

Related U.S. Application Data

(60) Provisional application No. 63/607,220, filed on Dec. 7, 2023.

(51) Int. Cl.
*A63C 11/22* (2006.01)
*A63B 59/70* (2015.01)

(52) U.S. Cl.
CPC ..... *A63C 11/227* (2013.01); *A63B 59/70* (2015.10); *A63C 11/2228* (2020.08)

(58) Field of Classification Search
CPC ... A63C 11/227; A63C 11/22; A63C 11/2228; A63B 59/70
See application file for complete search history.

(56) References Cited

U.S. PATENT DOCUMENTS 5,967,913 A * 10/1999 Sulenta ..... A63B 60/22 473/449
10,279,235 B2 * 5/2019 Jean ..... A63B 71/0045
2021/0245023 A1 * 8/2021 Zorick ..... A63B 59/70
2025/0381460 A1 * 12/2025 Knaust ..... A63B 59/70

FOREIGN PATENT DOCUMENTS

WO WO-9316613 A1 * 9/1993 ..... A63C 11/22

* cited by examiner

*Primary Examiner* — John D Walters
(74) *Attorney, Agent, or Firm* — Smith, Gambrell & Russell LLP

(57) ABSTRACT

An adapter comprises a main body having an insertion portion configured to be disposed in a hollow end of a hockey stick, a collar disposed adjacent the insertion portion and configured to abut a portion of the hockey stick, and a ski pole tip disposed opposite the insertion portion.

20 Claims, 5 Drawing Sheets

SYSTEMS AND METHODS FOR CONVERTING HOCKEY STICKS TO SKI POLES

CROSS REFERENCE TO RELATED APPLICATIONS

This application claims the benefit of priority to U.S. Provisional Patent Application Ser. No. 63/607,220, filed Dec. 7, 2023, entitled "Systems and Methods for Converting Hockey Sticks to Ski Poles," the disclosure of which is incorporated herein by reference in their entirety.

BACKGROUND

Traditional ski poles lack sustainability and often contribute to environmental waste. Conversely, millions of retired or broken hockey sticks are discarded annually, leading to environmental concerns.

Improvements are needed.

SUMMARY

The present disclosure relates to systems and methods for repurposing hockey sticks into functional ski poles, reducing waste and providing skiers with durable, customizable, and nostalgic ski pole options.

In an aspect, the present disclosure comprises a conversion system that transforms retired or broken hockey sticks into functional ski poles. The systems and methods may utilize an adapter to fit a replacement tip and basket onto the hockey stick, creating a versatile and ergonomic ski pole suitable for various skiing terrains and user preferences.

BRIEF DESCRIPTION OF THE DRAWINGS

The following drawings show generally, by way of example, but not by way of limitation, various examples discussed in the present disclosure. Like numerals reference similar elements. In the drawings.

Figures 1A, 1B, 2:
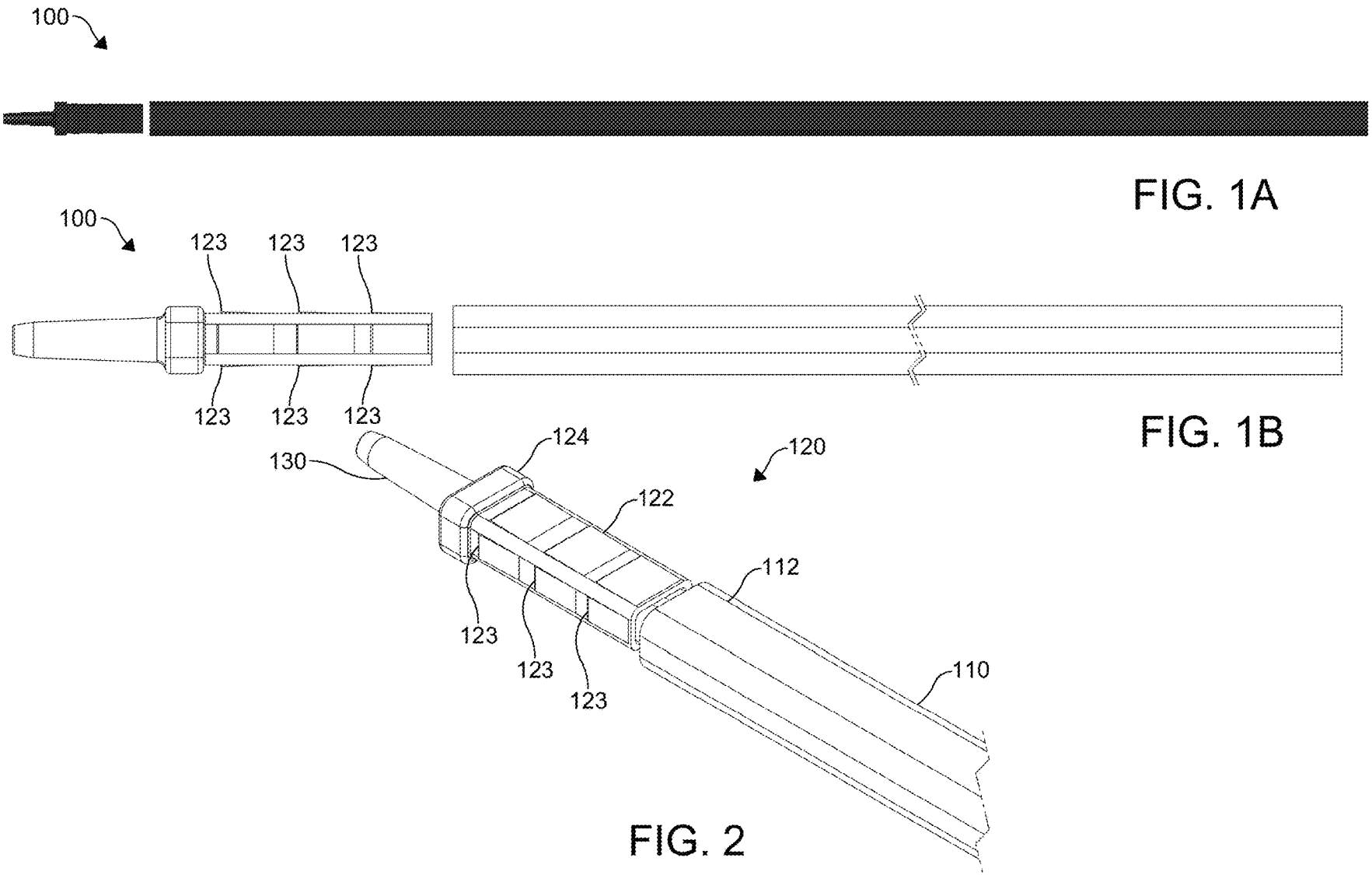
FIGS. 1A-1B show an example hockey stick with a ski adapter according to the systems and methods disclosed herein.
FIG. 2 shows the example hockey stick with the ski adapter of FIG. 1.
Figure 5:
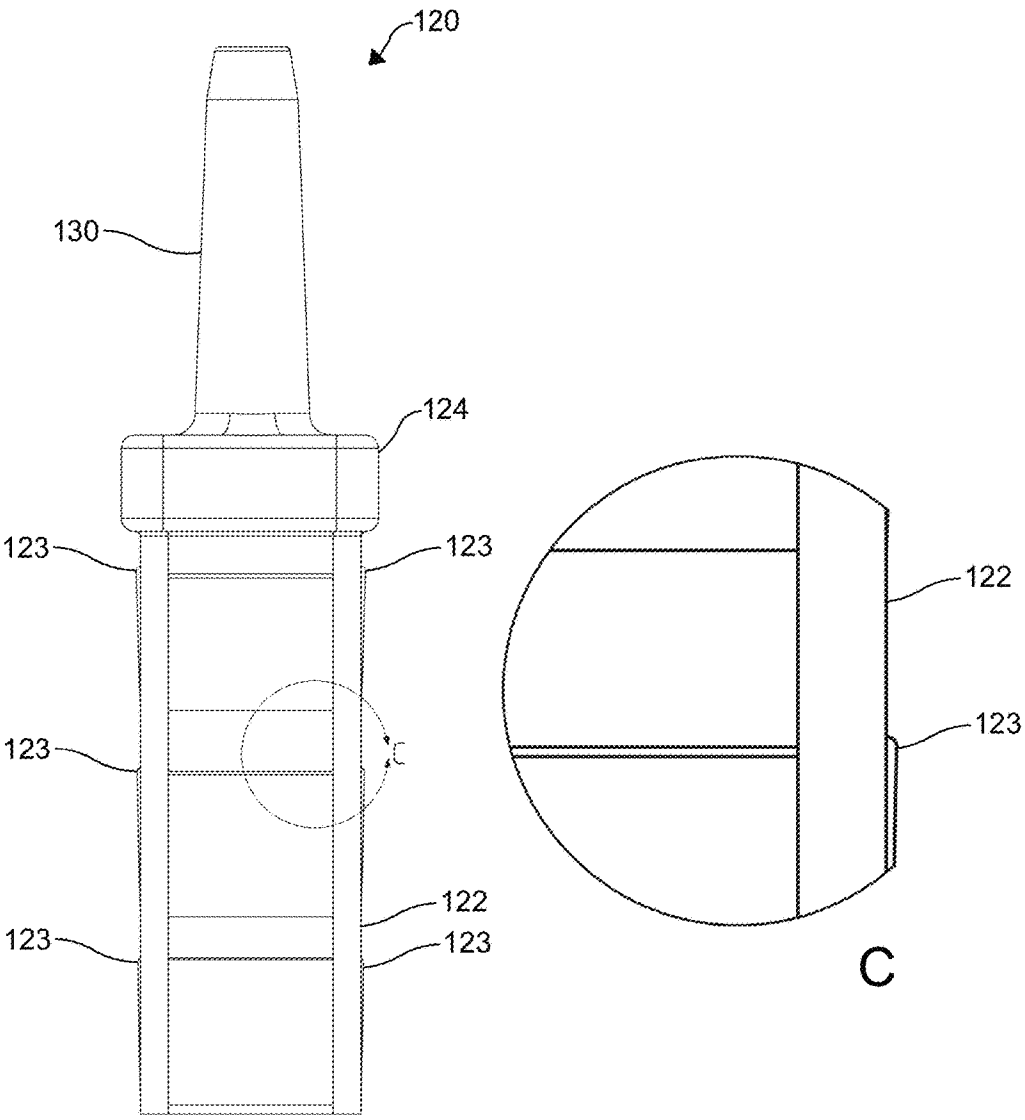
FIG. 5 illustrates an example adapter according to the systems and methods disclosed herein, showing an exploded view of circle C.
Figure 3:
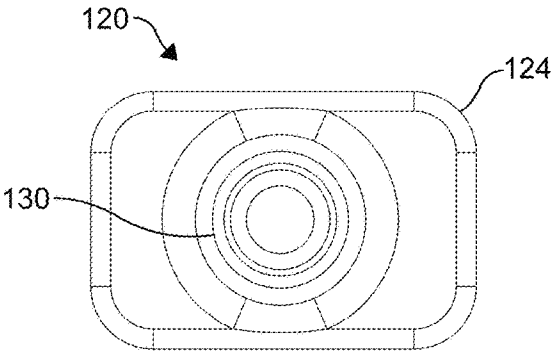
FIG. 3 illustrates an example adapter according to the systems and methods disclosed herein.
Figure 4:
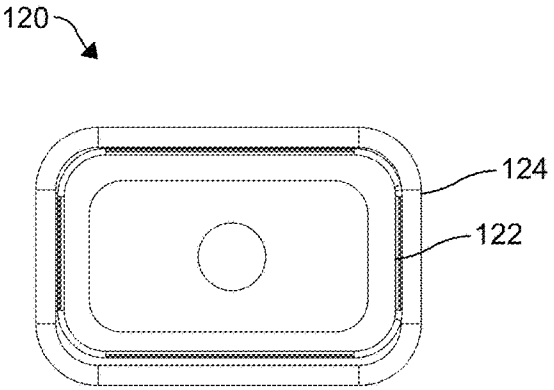
FIG. 4 illustrates an example adapter according to the systems and methods disclosed herein.
Figure 6:
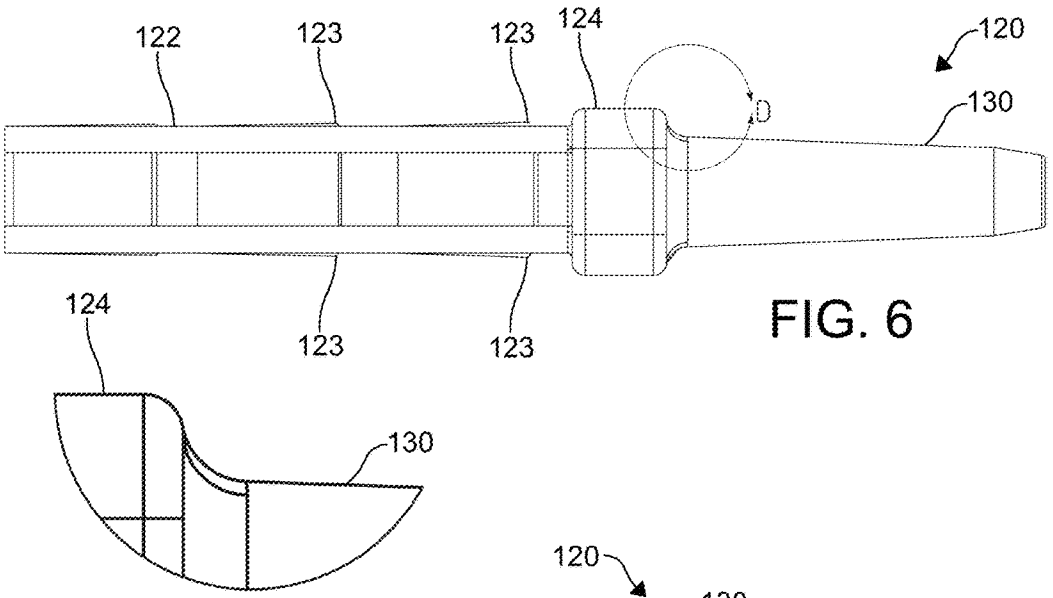
FIG. 6 illustrates an example adapter according to the systems and methods disclosed herein, showing an exploded view of circle D.
Figure 7:
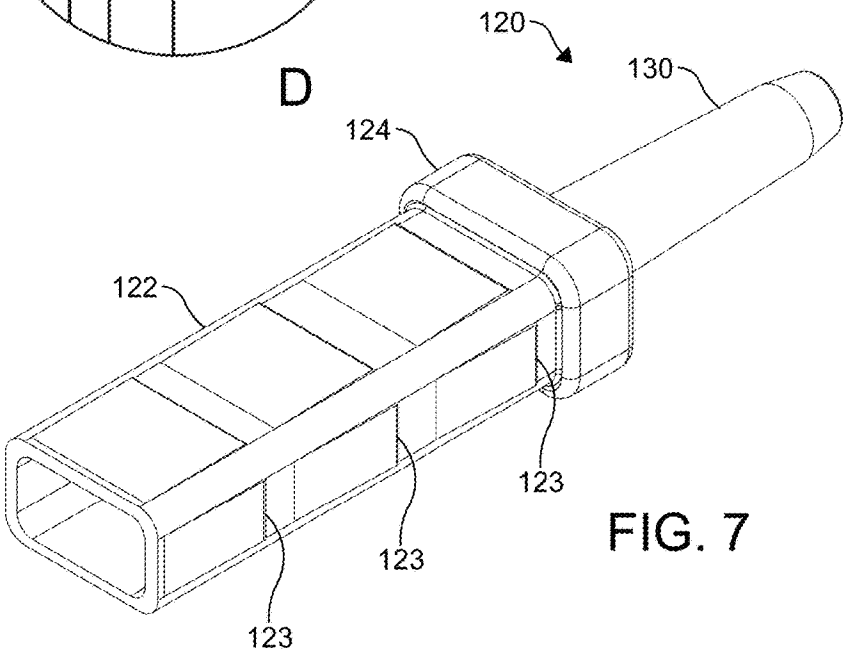
FIG. 7 illustrates an example adapter according to the systems and methods disclosed herein.
Figure 8A:
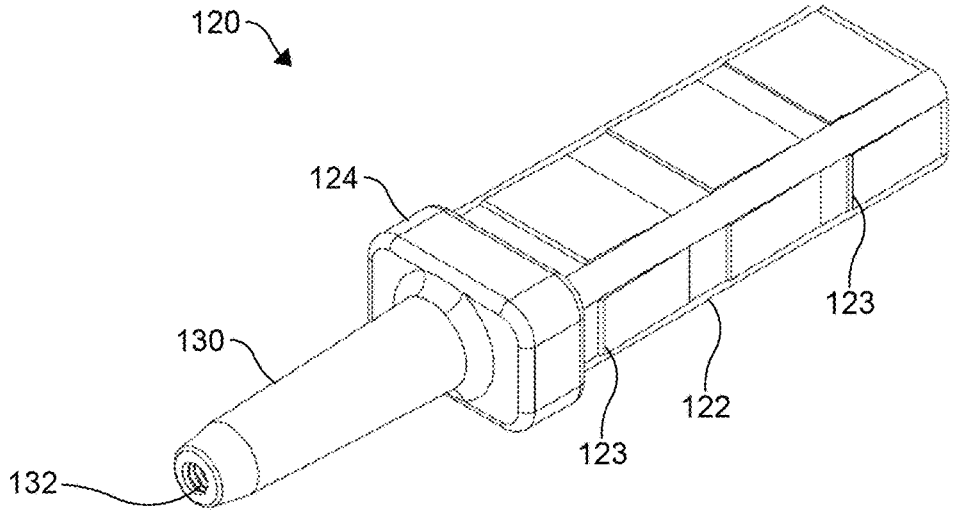
FIGS. 8A-8E illustrate an example adapter according to the systems and methods disclosed herein.
Figure 8B:
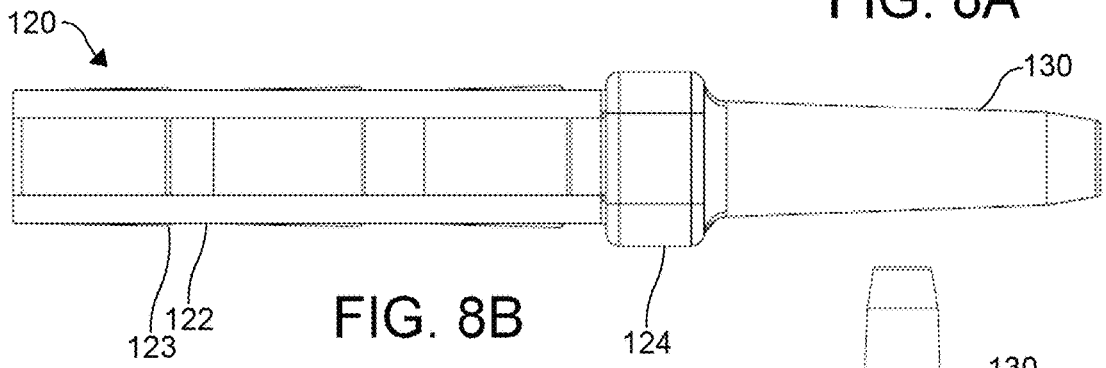
Figure 8C:
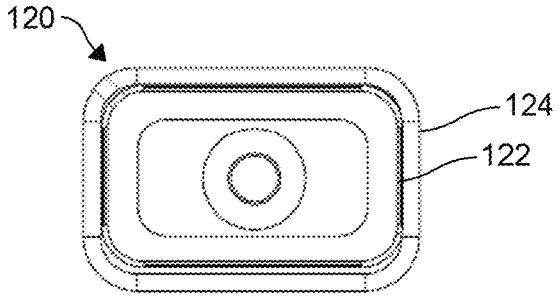
Figure 8D:
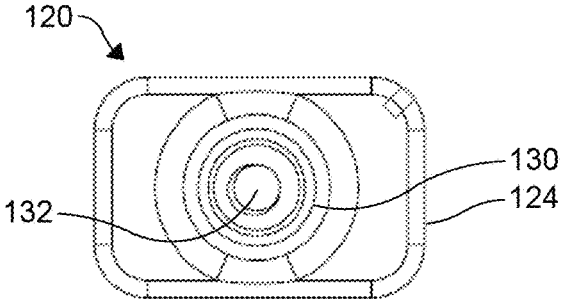
Figure 8E:
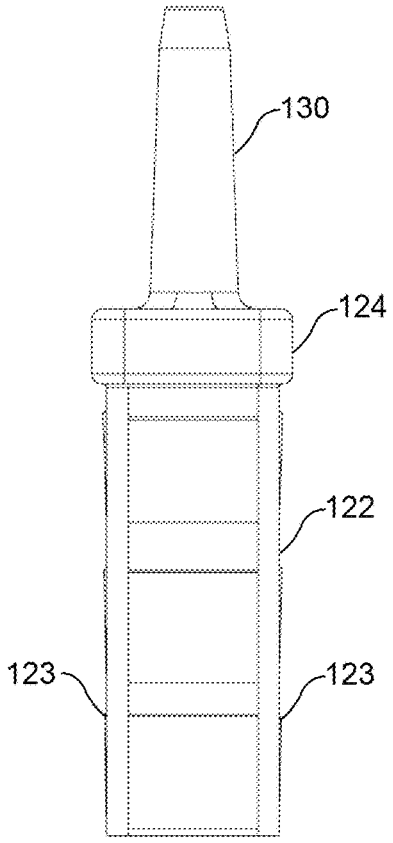
Figure 9A:
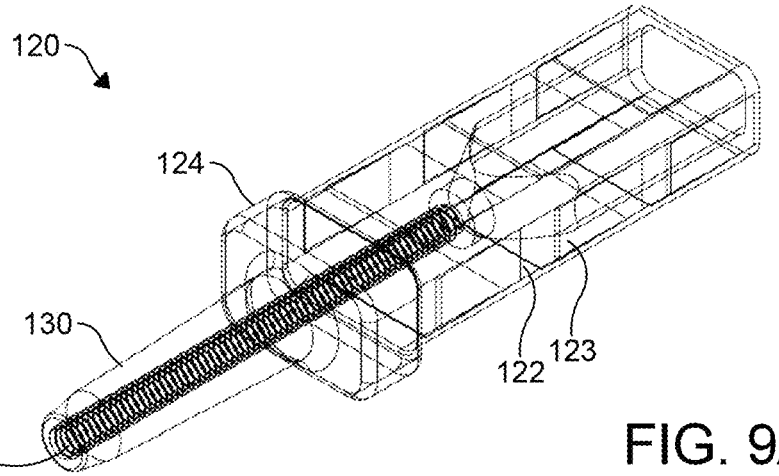
FIGS. 9A-9E illustrate an example adapter according to the systems and methods disclosed herein.
Figure 9B:
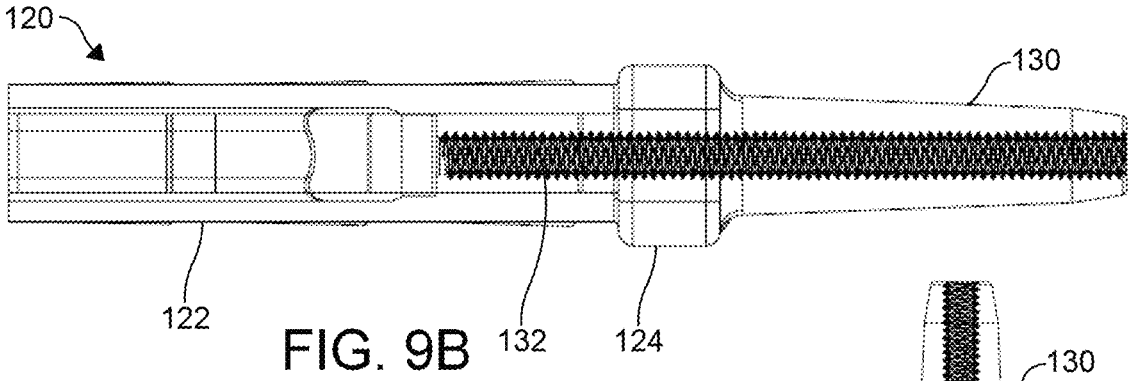
Figure 9C:
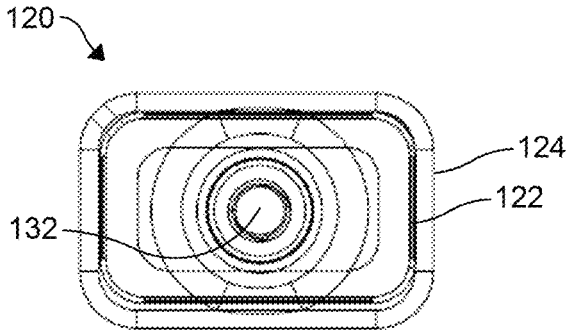
Figure 9D:
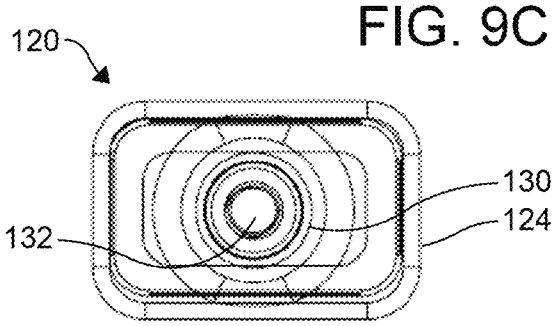
Figure 9E:
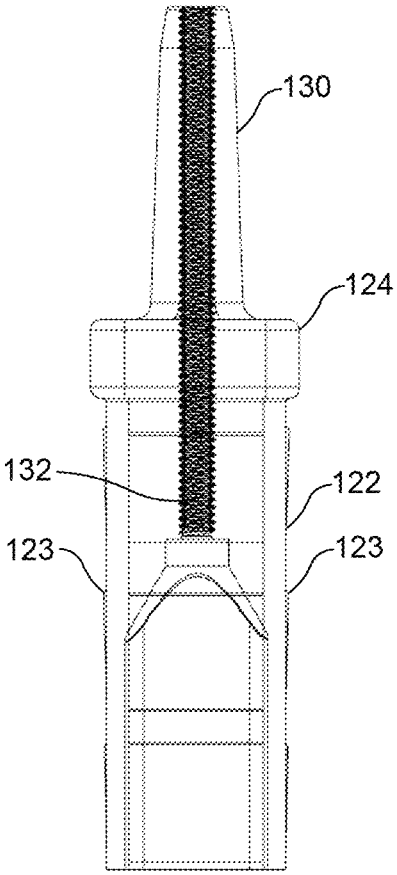

The accompanying drawings show examples of the disclosure. It is to be understood that the examples shown in the drawings and/or discussed herein are non-exclusive and that there are other examples of how the disclosure may be practiced.

DETAILED DESCRIPTION

The present disclosure relates to conversion systems, methods, and adapter that transform retired or broken hockey sticks into functional ski poles. As an example, the present disclosure provides an adapter to fit a replacement tip and basket onto the hockey stick, creating a versatile and ergonomic ski pole suitable for various skiing terrains and user preferences.

As an illustrative example FIGS. 1-2 show a system 100 may comprise a hockey stick 110 and an adapter 120. As shown, the adapter 120 comprises a tip portion 130 configured to receive a replaceable ski pole tip and/or basket. The tip portion 130 may be tapered. The tip portion 130 may have a generally conical shape with a blunt end. Other components may be used. Other components may include a grip, a wristlet, and/or a plug.

In an aspect, the hockey stick 110 may comprise a discarded/recycled hockey stick, which may be formed from various materials such as wood, polymer, carbon fiber, composites, and the like. As an illustrative example, used hockey sticks may be sourced from local ice rinks. As a further example, approximately 3.7 million sticks are manufactured annually, with 75% ending up in landfills due to breakage or expiration of warranties.

In an aspect, the adapter 120 may be configured to be disposed on an end 112 of the hockey stick 110. The adapter 120 may be constructed from various materials (e.g., polymer, thermoplastic, acrylonitrile butadiene styrene (ABS)). The adapter 120 may be formed from various manufacturing techniques (e.g., 3D printing). In use, the adapter 120 is disposed at the end 112 of the hockey stick 110. As an example, the end 112 may be hollow and the adapter 120 may be configured to be disposed into the end 112. As a further example, the adapter 120 may be coupled to the hockey stick 110 with a coupling device such as a screw capable of withstanding up to 2000 PSI. Other coupling devices and parameters may be used.

As shown in FIGS. 1-9, the adapter 120 comprises a main body 122 having an insert portion 124, a collar 126, and the tip 130 disposed opposite the insert portion 124. The adapter 120 may be designed to provide stability and support while skiing, especially during lift disembarking, mountain climbing, and downhill skiing. As an illustrative example, the insert portion 124 is inserted into the end 112 of the hockey stick 110 up to the collar 126. The adapter 120 may be friction fitted or secure by a coupling means. As an illustrative example, one or more angled barbs 123 may be formed or disposed to extend radially outwardly from the main body 122. The one or more angled barbs 123 may have various shapes such as a ramp shape with radially thickness extending from the main body 122 increasing from a proximal end of the main body 122 toward a distal end (e.g., tip 130) of the main body 122. The one or more angled barbs 123 may be solid or hollow. The one or more angled barbs 123 may have various size, shapes, or coupling features to engage the hockey stick 110 (e.g., an interior portion of the hockey stick 110).

Once disposed in the hockey stick 110, the tip 130 extends outwardly from the collar 126 and is configured to receive a replaceable ski pole tip. Replacement tips may be secured to the adapter 120 by friction fitting or coupling means. As an illustrative example, and as more clearly shown in FIGS. 8-9, an interior of the tip 130 (and/or main body 122) may further comprise a threaded portion 132. The thread portion 132 may be configured to engage ski pole tips or other features to secure to the tip 130. The threaded portion 132 may be formed in the main body 122 or may comprise a threaded insert disposed in a hollow main body 122. Other configurations may be used. Ski baskets and other ski pole features may be configured to be coupled to the adapter 120. As an example, universally sized replacement components compatible with the adapter 120 may enable easy attachment and securing to accommodate various skiing conditions.

Grips and/or wristlets may be provided. The grip, which may be made from various materials including nylon string and colored electrical tape, offers skiers a secure and comfortable handle adaptable to diverse terrains. Grips may include rubber handles. Other materials and shapes may be used. Wristlets, which may be made from hockey laces, ensure pole retention and user security during falls. Wristlets may include one or more of nylon webbing straps, plastic adjustable buckles, canvas boat snaps. Wristlets may be configured to break away if you were to fall. Wristlets may adjust for various users.

A plug may be provided and may secure the wristlet in place, enhancing skier safety. The plug may be formed from various materials.

The present disclosure includes at least the following aspects and examples:

Example Clause A: An adapter for a conversion system for recycled hockey sticks, the adapter may include: a main body having an insertion portion configured to be disposed in a hollow end of a hockey stick, main body has a cross-section that is rectangular; a collar disposed adjacent the insertion portion, the collar extending radially outwardly from the main body and configured to abut a portion of the hockey stick; and a tapered ski pole tip disposed opposite the insertion portion, where the insertion portion is tapered from the collar to a proximal end, and where the ski pole tip is disposed at a distal end of the adapter.

Example Clause B: The adapter of Example Clause A, where the main body has a cross-section that is rectangular with one or more rounded corners.

Example Clause C: An adapter for a conversion system for recycled hockey sticks, the adapter may include: a main body having an insertion portion configured to be disposed in a hollow end of a hockey stick; a collar disposed adjacent the insertion portion, the collar extending radially outwardly from the main body and configured to abut a portion of the hockey stick; and a ski pole tip disposed opposite the insertion portion.

Example Clause D: The adapter of Example Clause C, where at least a portion of the insertion portion of the main body is hollow.

Example Clause E: The adapter of Example Clause C or Example Clause D, where the insertion portion is tapered from the collar to a proximal end, and where the ski pole tip is disposed at a distal end of the adapter.

Example Clause F: The adapter of any one of Example Clauses C-E, where the main body has a cross-section that is rectangular.

Example Clause G: The adapter of any one of Example Clauses C-F, where the main body has a cross-section that is rectangular with one or more rounded corners.

Example Clause H: The adapter of any one of Example Clauses C-G, where the collar has a cross-section that is rectangular.

Example Clause I: The adapter of any one of Example Clauses C-H, where the collar has a cross-section that is rectangular with one or more rounded corners.

Example Clause J: The adapter of any one of Example Clauses C-I, where the ski pole tip is tapered.

Example Clause K: The adapter of any one of Example Clauses C-J, where the main body is formed from polymer.

Example Clause L: A conversion system for recycled hockey sticks, the conversion system may include: a hockey stick having a hollow end; and an adapter may include a main body having an insertion portion configured to be disposed in the hollow end of the hockey stick, a collar disposed adjacent the insertion portion and configured to abut a portion of the hockey stick, and a ski pole tip disposed opposite the insertion portion.

Example Clause M: The conversion system of Example Clause L, where at least a portion of the insertion portion of the main body is hollow.

Example Clause N: The conversion system of Example Clause L or Example Clause M, where the insertion portion is tapered from the collar to a proximal end, and where the ski pole tip is disposed at a distal end of the adapter.

Example Clause O: The conversion system of any one of Example Clauses L-N, where the main body has a cross-section that is rectangular.

Example Clause P: The conversion system of any one of Example Clauses L-O, where the main body has a cross-section that is rectangular with one or more rounded corners.

Example Clause Q: The conversion system of any one of Example Clauses L-P, where the collar has a cross-section that is rectangular.

Example Clause R: The conversion system of any one of Example Clauses L-Q, where the collar has a cross-section that is rectangular with one or more rounded corners.

Example Clause S: The conversion system of any one of Example Clauses L-R, where the ski pole tip is tapered.

Example Clause T: The conversion system of any one of Example Clauses L-S, where the main body is formed from polymer.

Example Manufacturing Process:

As a non-limiting illustrative example, a retired hockey stick undergoes cleaning and modification, cutting both ends for even surfaces. The adapter, secured using welding glue, is inserted into the hockey stick and allowed to set. Construction of the grip involves nylon lace wrapping and covering it with electrical tape for durability. The wristlet is secured using welding glue and inserted into the top of the hockey stick ski pole and secured by the plug which is also secured using welding glue. The replacement tip and basket are affixed to the adapter to complete the ski pole conversion.

As an illustrative example, the present disclosure offers functional ski poles while repurposing discarded hockey sticks. Each ski pole carries its own history and durability from previous use, catering to varied user preferences. Its uniqueness lies in sustainability, personalization, and nostalgia within the skiing and hockey communities.

What is claimed is:

1. An adapter for a conversion system for recycled hockey sticks, the adapter comprising:

a main body having an insertion portion configured to be disposed in a hollow end of a hockey stick, main body has a cross-section that is rectangular;

a collar disposed adjacent the insertion portion, the collar extending radially outwardly from the main body and configured to abut a portion of the hockey stick; and a tapered ski pole tip disposed opposite the insertion portion, wherein the insertion portion is tapered from the collar to a proximal end, and wherein the ski pole tip is disposed at a distal end of the adapter.

2. The adapter of claim 1, wherein the main body comprises one or more angled barbs extending radially outwardly from the main body.

3. An adapter for a conversion system for recycled hockey sticks, the adapter comprising:

a main body having an insertion portion configured to be disposed in a hollow end of a hockey stick;

a collar disposed adjacent the insertion portion, the collar extending radially outwardly from the main body and configured to abut a portion of the hockey stick; and a ski pole tip disposed opposite the insertion portion.

4. The adapter of claim 3, wherein at least a portion of the insertion portion of the main body is hollow.

5. The adapter of claim 3, wherein the insertion portion is tapered from the collar to a proximal end, and wherein the ski pole tip is disposed at a distal end of the adapter.

6. The adapter of claim 3, wherein the main body has a cross-section that is rectangular.

7. The adapter of claim 3, wherein the main body comprises one or more angled barbs extending radially outwardly from the main body.

8. The adapter of claim 3, wherein the collar has a cross-section that is rectangular.

9. The adapter of claim 3, wherein the collar has a cross-section that is rectangular with one or more rounded corners.

10. The adapter of claim 3, wherein the ski pole tip is tapered.

11. The adapter of claim 3, wherein the main body is formed from polymer.

12. A conversion system for recycled hockey sticks, the conversion system comprising:

a hockey stick having a hollow end; and an adapter comprising a main body having an insertion portion configured to be disposed in the hollow end of the hockey stick, a collar disposed adjacent the insertion portion and configured to abut a portion of the hockey stick, and a ski pole tip disposed opposite the insertion portion.

13. The conversion system of claim 12, wherein at least a portion of the insertion portion of the main body is hollow.

14. The conversion system of claim 12, wherein the insertion portion is tapered from the collar to a proximal end, and wherein the ski pole tip is disposed at a distal end of the adapter.

15. The conversion system of claim 12, wherein the main body has a cross-section that is rectangular.

16. The conversion system of claim 12, wherein the main body comprises one or more angled barbs extending radially outwardly from the main body.

17. The conversion system of claim 12, wherein the collar has a cross-section that is rectangular.

18. The conversion system of claim 12, wherein the collar has a cross-section that is rectangular with one or more rounded corners.

19. The conversion system of claim 12, wherein the ski pole tip is tapered.

20. The conversion system of claim 12, wherein the main body is formed from polymer.

* * * * *